United States Patent [19]

Asphar

[11] Patent Number: 4,562,940

[45] Date of Patent: Jan. 7, 1986

[54] DISPENSER MECHANISM FOR FLOWABLE PARTICULATE MATERIALS

[76] Inventor: Frank X. Asphar, 9 Sage Pl., Eastchester, N.Y. 10707

[21] Appl. No.: 509,650

[22] Filed: Jun. 30, 1983

[51] Int. Cl.[4] ..... B67B 7/24

[52] U.S. Cl. ..... 222/88; 222/91

[58] Field of Search ..... 222/83, 83.5, 80, 81, 222/89, 88, 91, 173, 184; 248/359 E; 206/222; 137/67, 68 R

[56] References Cited

U.S. PATENT DOCUMENTS

| | | | |
|---|---|---|---|
| 2,388,567 | 11/1945 | Patterson, Jr. | 248/359 E |
| 2,787,248 | 4/1957 | Brendle | 222/88 |
| 2,859,898 | 11/1958 | Mendenhall | 222/83 |
| 3,114,480 | 12/1963 | Sauter | 222/91 |
| 3,239,104 | 3/1966 | Scholle | 222/81 |
| 3,642,172 | 2/1972 | Malpas | 222/90 |
| 3,878,964 | 4/1975 | Fogle | 248/359 E |
| 3,927,803 | 12/1975 | Weber | 222/91 |
| 3,995,773 | 12/1976 | Schmit | 222/91 |
| 4,120,420 | 10/1978 | Dirksing | 222/81 |

FOREIGN PATENT DOCUMENTS

| | | | |
|---|---|---|---|
| 45725/79 | 7/1978 | Austria . | |
| 80/00556 | 9/1978 | Fed. Rep. of Germany . | |
| 1414863 | 9/1965 | France | 222/88 |
| 206569 | 8/1939 | Switzerland . | |
| 993462 | 5/1965 | United Kingdom . | |

*Primary Examiner*—Joseph J. Rolla
*Assistant Examiner*—Kenneth Noland
*Attorney, Agent, or Firm*—Thaddius J. Carvis

[57] ABSTRACT

The object of the invention is to provide a unit for holding, opening, dispensing, and storing packaged particulate materials. The dispensing unit of the invention will comprise a support (20) for a package (36) containing a flowable particulate material, a cutting member (22) for opening the package, and a removable closure (24) to cover a dispensing opening (30) in the side wall (28) of the support. The cutting member has at least one sharpened piercing portion (38) and a sharpened leading edge (42) to provide a clean cut into the package by transverse and preferably rotating movement relative to the package.

12 Claims, 15 Drawing Figures

FIG. 4
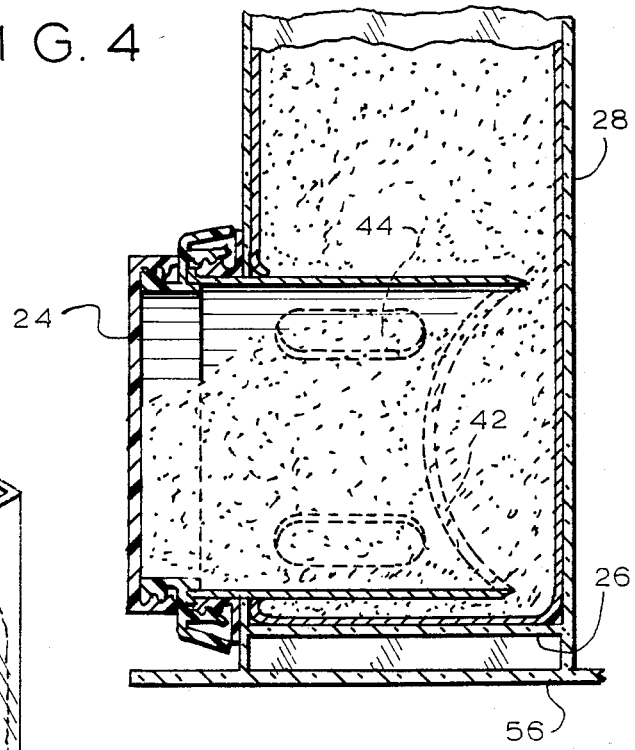
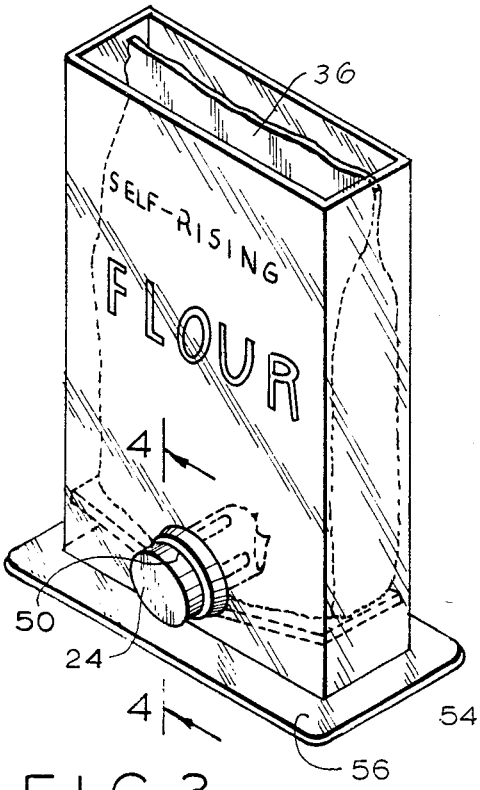
FIG. 3
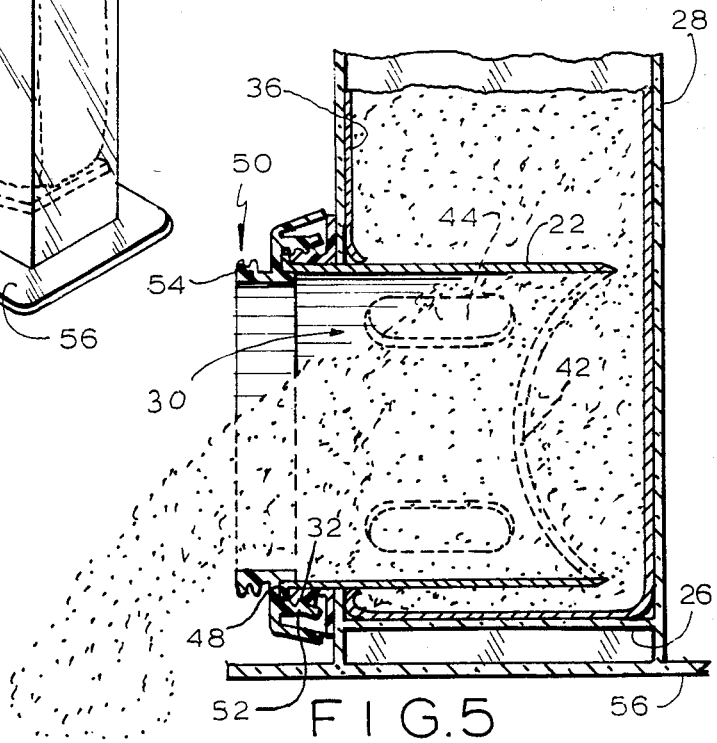
FIG. 5

DISPENSER MECHANISM FOR FLOWABLE PARTICULATE MATERIALS

DESCRIPTION

1. Technical Field

The invention relates to dispensers for flowable particulate materials of the type normally distributed in packages, such as bags and boxes, which can be easily opened for initial use but, once opened, pose problems in terms of storage and reuse. More particularly, the invention relates to dispensers of this type which neatly cut openings into such packages to facilitate unrestricted flow of particulate material as needed, while also permitting closing of the openings for spill-free storage over extended periods of use.

The use of paper or paperboard packaging for flowable particulate materials such as sugar, flour, rice, baking soda, soap powder, plant food, fertilizer, potting soil, chemicals, salt for melting snow, cement, animal feed, and the like, provides low costs and adequate protection during commercial storage and handling; however, packaging materials of this type present problems of spillage and sanitation after opening. Opened packages of food materials made from paper products, whether or not lined with a waxed paper or polymer film, typically result in spillage in the counter area or in cupboards, often attracting ants, roaches, rodents and the like. The storage of non-edible materials, such as fertilizer and potting soil, are also associated with spillage and mess. It would be desirable to have a dispenser unit adapted to hold a package containing a flowable particulate material, to cut an opening in the package, to freely dispense the desired amount of particulate material, and to cover the opening to prevent spillage during periods of storage.

2. Background Art

Typically, when a package of sugar, detergent, or other flowable particulate material is opened, the contents are either stored in the package itself or emptied into a separate canister. When the container itself is employed, the foregoing problems of mess and the like must be contended with. Where the products are removed to a separate canister, mess is also associated with opening it and removal of measured quantities therefrom. Moreover, the step of emptying the contents of the package into the canister creates further opportunity for spillage.

Distinct from the problems normally associated with granular materials, there have been a number of attempts to package liquid materials in paper containers having water-proof liners. As an alternative to providing pour spouts which are integral with the plastic liner, a number of workers have developed attachable spigots having a piercing member at one end. Typical of these devices are those shown in U.S. Pat. No. 3,642,172 to Malpas, U.S. Pat. No. 3,239,104 to Scholle and Austrian Pat. No. 246,639, all of which show spigots or spouts capable of piercing the inner liner and providing an outlet for the liquid held therein. While these devices may provide useful mechanisms for use with liquids, they all require some means for sealing the area between the inner liner and the paper container to prevent leakage and do not address the problems associated with packaging particulate products.

Due, among other things to differences in packaging materials and the different flow characteristics, the problems associated with them are quite different than those associated with liquids. For example, it has been determined that the utilization of a seal between an inner liner and an outer package is not required to prevent leakage where an opening is cut to closely conform to an outlet passage forming means. However, merely cutting an opening in a package holding a particulate material will not assure that the material can flow easily from the package. The ragged openings caused by the insertion of a piercing member often obstruct the flow of particulate material. Because of the greater flowability of liquid materials, and the resiliency of the usual packaging films, such as employed by Malpas and Scholle, the piercing member used for liquid materials does not typically provide ragged edges which obstruct the flow of material from the pour spout. With the particulate materials, on the other hand, the simple step of piercing a paper of paperboard package creates flaps or ragged tears which interfere with the flow of particulate materials from the packages. The presence of tears also results in the spillage of material, and attempts to remove the rough edges by a separate tearing step not only creates further opportunity for spillage but often worsens the tear.

Accordingly, it would be desirable, in addition to providing a piercing member which cleanly cut the packaging material in the area of the outlet, to provide a holder having a closeable spout portion so that spillage of a particulate material would not result in the problems which has concerned the art until this time.

DISCLOSURE OF INVENTION

In accordance with the present invention, there is provided a dispenser unit adpated to hold a package containing a flowable, particulate material, to cut an opening in the package, to dispense the desired amount of particulate material, and to cover the opening in the package when dispensing is not desired, comprising: (a) a support for a package containing flowable particulate material, the support comprising a bottom and an upstanding peripheral side wall portion, the side wall portion having a circular opening therethrough; (b) a tubular cutting member dimensioned to be closely received and rotate within said circular opening and adapted to move transversely to said side wall to penetrate said package, whereby upon insertion, said cutting member cuts a circular opening in said package enabling unrestricted flow of particulate material from said package through said opening; and (c) removable closure means for covering said opening.

According to a preferred embodiment of the invention, the bottom wall of the package support will have a dihedral configuration to facilitate positioning of the circular opening and the tubular cutting member at the lowermost portion of the bottom.

According to another preferred aspect of the invention, the peripheral side wall portion of the package support will receive a cover member which preferably fits in closefitting, telescoping relationship with the upstanding peripheral side wall portion to permit the cover to lower to a predetermined extent as the level of particulate material held within a compressible package is reduced.

According to another preferred aspect of the invention, the dispenser unit will comprise a tiltable base which enables the package to be tilted to pour material from the container without lifting the support or the package contained therein.

According to another embodiment of the present invention, the dispenser unit will include wheels or provide means for attaching it to a wheeled transport mechanism to facilitate the dispensing of particulate materials from large size bags or drums, typically the 50 pound or larger bags or drums associated with the distribution of bulk materials such as fertilizer, cement, animal feed, or chemicals.

According to a specific feature of a preferred embodiment according to the present invention, the tubular cutting member has at least one sharpened projection which is adapted to pierce a package upon insertion into the circular opening in the side wall, and to completely cut out a circular piece of packaging material upon rotation of the cutting member within said opening.

BRIEF DESCRIPTION OF THE DRAWINGS

The present invention will be further described and its advantages will become more apparent from the following detailed description, especially when read in light of the accompanying drawings wherein:

FIG. 3 is a perspective view of the dispenser unit of FIG. 1, shown assembled, with the cutting member shown in phantom lines extending into a package;

FIG. 4 is a sectional view taken along line 4—4 in FIG. 3 showing the dispenser unit of FIG. 3 with the removable closure means in place over the dispensing opening;

FIG. 5 is a view similar to that of FIG. 4, but with the closure means removed;

DETAILED DESCRIPTION OF THE INVENTION

Figure 1:
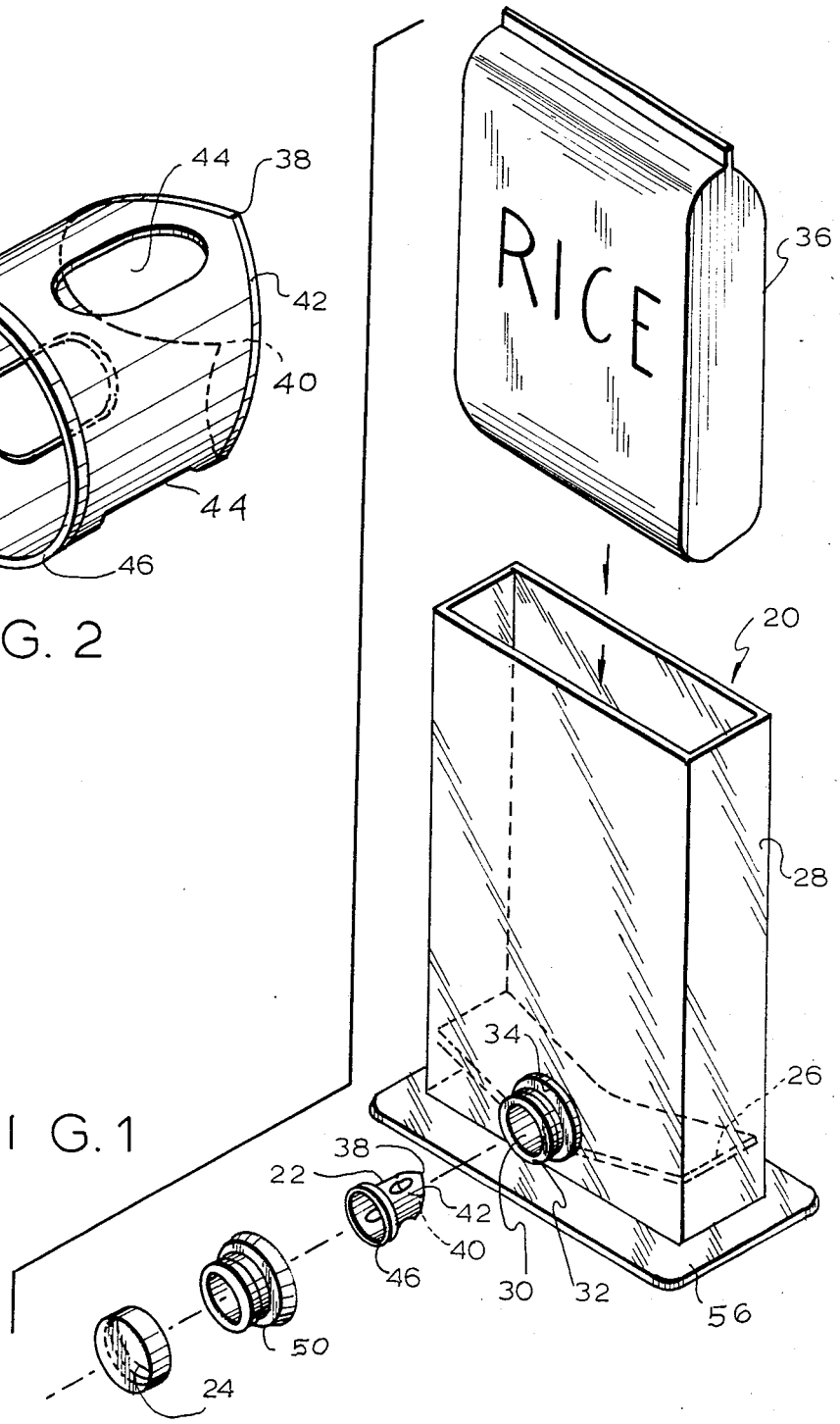
FIG. 1 is an exploded perspective view of a preferred embodiment of a dispenser unit according to the invention.

The embodiment shown in FIGS. 1 through 5 represents one preferred dispenser unit according to the present invention. FIG. 1 shows the principle parts of the apparatus in exploded fashion, indicating their relative positions with respect to each other and a package of particulate material to be held by and dispensed from the unit. The dispenser unit shown in FIG. 1 comprises a support, shown generally as 20, for containing flowable particulate material, a tubular cutting member 22, and a removable closure means 24. The support 20 comprises a bottom 26, an upstanding peipheral side wall portion 28, and a circular opening 30 in the side wall portion 28. In the embodiment shown, the circular opening 30 has a threaded tubular fitting 32 with an integral annular flange 34 surrounding the opening 30 and affixed to the side wall portion 28. As can be seen in the cross-sectional views in FIGS. 4 and 5, the flange can be affixed to the upstanding side wall 28 by means of a suitable solvent, adhesive, or welding.

The opening 30 in the side wall portion 28 is juxtaposed with the bottom wall 26, spaced just sufficiently to provide freedom of movement of the cutting member 22 to penetrate the package 36 containing the particulate material. For packages having flexible walls, it is preferred that the bottom 26 have a dihedral configuration, as shown in the drawing, so that the package 36 will conform to that shape and permit the particulate material contained therein to collect towards the location of the opening 30.

The tubular cutting member 22 is dimensioned to be closely received and rotate within the circular opening 30 and is shown to have two pointed piercing members 38 and 40. The leading edge 42 of the cutting member 22 is sharpened such that the movement of the member 22 upon insertion through the opening 30 will first pierce and then cut the packaging material cleanly. According to some embodiments, the cutting member 22 is made of sufficient length to permit clean cutting of a complete circular opening within the package 36 simply by forcing it through the opening transversely to the side wall 28 of the support 20. According to the preferred mode of operation of the dispenser unit, however, the tubular cutting member 22 is rotated upon insertion through the circular opening 30 to provide a clean cutting action with decreased resistance to the movement of the cutting member 22 into the package 36 and the particulate material it contains.

Figure 2:
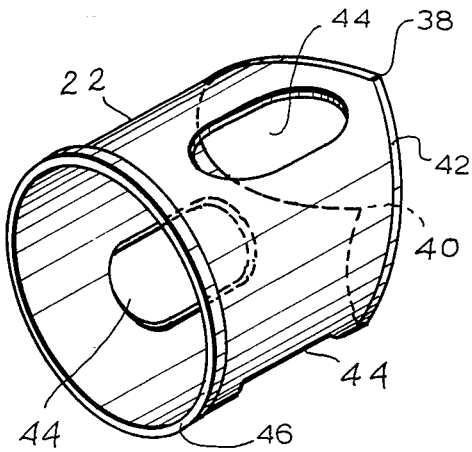
FIG. 2 is an enlarged view of a preferred tubular cutting member according to the present invention.

The detail of the cutting member is shown better in FIGS. 2, 4 and 5 as having a sharpened leading edge 42 which is beveled inwardly from the outer surface toward the inner surface. This knife-edge-type of bevel not only provides a clean severance of packaging material, but provides a slight degree of compression of the packaging material against the outer tubular body of the cutting member 22 while not stretching the material sufficiently to cause a ripping action. This enhances the ability of the dispenser unit to fully dispense the contents of the package 36 without spillage of the contents within the support 20.

The cutting member 22 is further shown to have a plurality of openings 44. The openings should be of sufficient size to enable the particulate material maintained within the package 36 to freely flow therethrough and into the passageway formed by the cutting member 22 when it is in place as shown in FIGS. 4 and 5. The combination of the openings 44 and the ability of the cutting member 22 to be rotated provides the advantage that clumps of material which would normally block passage through the interior of the cutting member can be broken up by simply rotating the member.

The cutting member is preferably maintained within the package 36 in its fully inserted position as shown in FIGS. 4 and 5 to provide a flow channel for material to be dispensed; however, it is fully within the scope of the invention to remove the cutting member after the opening in the package 36 has been cleanly cut. To facilitate retention of the cutting member in its fully inserted position, the cutting member is provided with a flange 46 which abuts the end of tubular member 32 and the interior seat 48 of a spout member 50 which has threads 52 for attaching the spout member 50 to the threaded cylindrical member 32. The spout member 50 further is shown in FIGS. 1, 4 and 5 as having threads 54 for engagement with mating threads in the interior of removable closure means 24. The removable closure means 24 is shown in place in Figures 3 and 4, and is shown to be removed to permit dispensing in FIG. 5.

According to the embodiments shown in FIGS. 1 through 10, the upstanding peripheral side wall portion 28 extends downwardly from the bottom 26 for attachment to a support base 56. The provision of the enlarged support base 56 provides greater stability to the dispenser unit to minimize the chance for accidental spills due to tipping.

Figure 6:
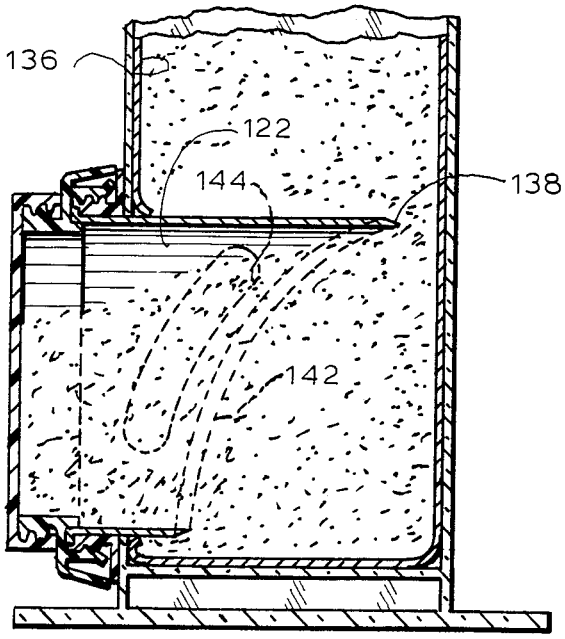
FIG. 6 is a view similar to that shown in FIG. 4, but showing an alternative form of tubular cutting member.
Figure 7:
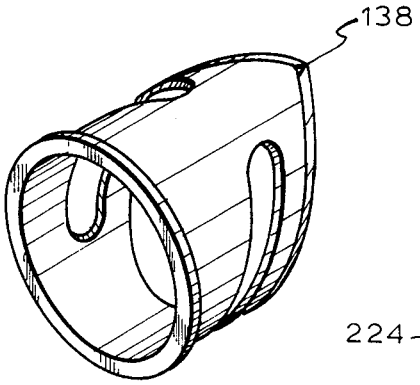
FIG. 7 is a perspective view of the alternative cutting member shown in place in FIG. 6.
Figure 8:
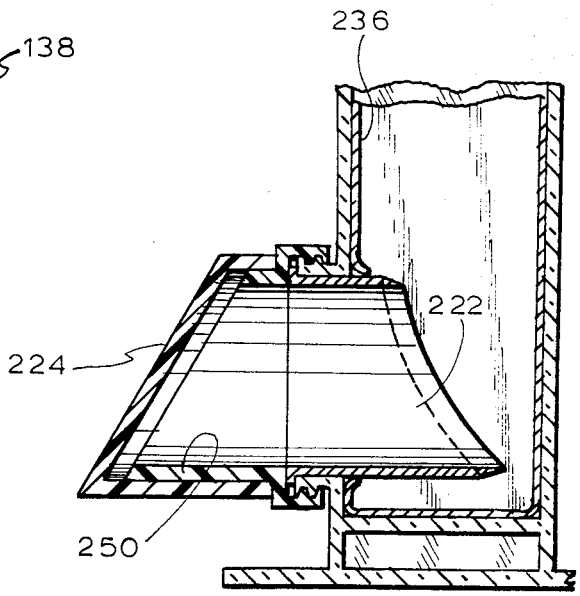
FIG. 8 is a view similar to that shown in FIG. 6, but showing a modified tubular cutting member rotated one half turn and showing a different spout and a slidably-fitting closure member thereover.

FIGS. 6 through 8 show variation on the embodiments shown in FIGS. 1 through 5. FIGS. 6 and 7 show a cutting member 122 having a single pointed piercing member 138 with a knife edge 142 extending around its leading edge. The cutting member 122 is shown in FIGS. 6 and 7 shown to have openings 144 which are aligned generally along lines parallel to the leading edge 142. The cutting member 122 is shown to be inserted with the pointed piercing member 138 in the uppermost vertical position. This is a preferred manner for inserting the cutting member because it provides the best penetration into the package 36 and enables providing the cleanest cut without the need for rotation. Inserting the cutting member as shown in FIG. 6 directly into a package as shown in FIG. 6 without rotation can result in the complete severance of a circular hole into the package. It is an advantage of the present invention, however, that, should the severance be less than complete, the packaging material still does not rip or tear, and a circular flap of packaging material can be simply removed by tearing the packaging material only at a small portion of the circumference of the cutting member. Clean cutting is enhanced according to the invention because, with the cutting member 122 in place, the simple withdrawal of the flap of packaging material draws it against the knife-sharp leading edge 142.

The cutting member 222 shown in FIG. 8 is similar to that shown in FIGS. 6 and 7, differing in that no holes are provided in the side wall. For some materials, it is possible to obtain good dispensing action by positioning the cutting member with the longest extent of the piercing member positioned near the bottom as shown in FIG. 8. The embodiment of FIG. 8 further differs from those of the previous figures by the shape of the spout 250 and the mating removable closure means 224 which is shown in FIG. 8 to telescope over the spout 250.

Figure 10:
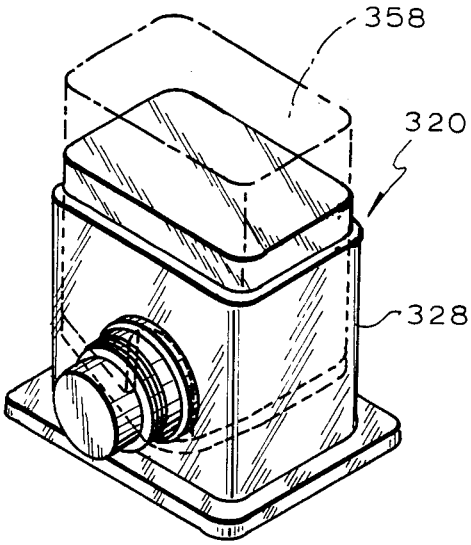
FIG. 10 is a perspective view, partially in phantom lines, showing the manner in which a cover member telescopes within the upstanding peripheral side wall portion to accomodate a smaller dispenser unit height as the amount of particulate material within the compressible packaging material is reduced.
Figure 9:
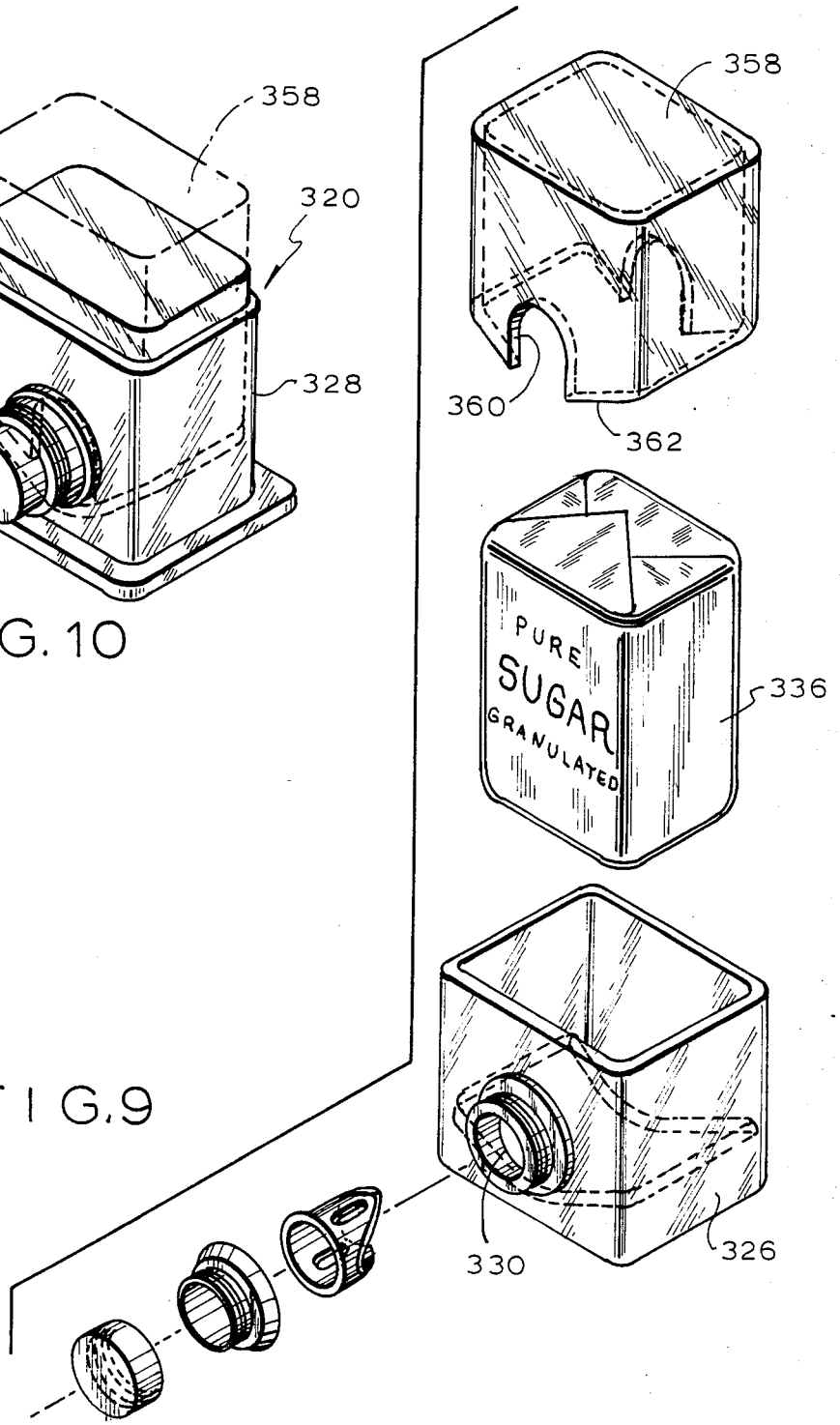
FIG. 9 is an exploded perspective view of another embhodiment according to the present invention which is preferred for use with flowable particulate materials packaged in compressible containers.

The embodiment of FIGS. 9 and 10 is similar to that of FIGS. 1 through 5, but provides the advantage of enabling covering the package of particulate material and permitting saving space by the telescoping action of the cover 358. As the amount of particulate material within the compressible packaging material is reduced, the cover 358 is lowered. FIG. 9 shows an exploded view clarifying the interrelationship of the various parts of the dispenser unit in similar fashion with FIG. 1. FIG. 10, partially in phantom lines, is a perspective view showing the manner in which the cover 358 telescopes within the upstanding peripheral side wall portion 328 of the support 320. The cover 358 has a cut-out 360 and a lower edge 362 which compliment the opening 330 and the dihedral bottom 326 to permit the cover to be lowered to the greatest extent as the quantity of material held within the compressible package 336 is reduced by being dispensed. This embodiment, therefore, has the dual advantage that the contents of the dispenser unit are protected from contamination by outside influences and of reducing the storage space required for the unit by permitting its height to be decreased as material is dispensed.

Figure 11:
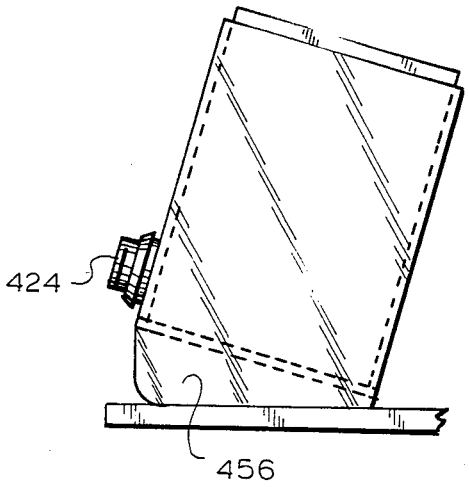
FIG. 11 shows an alternative embodiment according to the present invention wherein the dispenser unit has a tiltable base.
Figure 12:
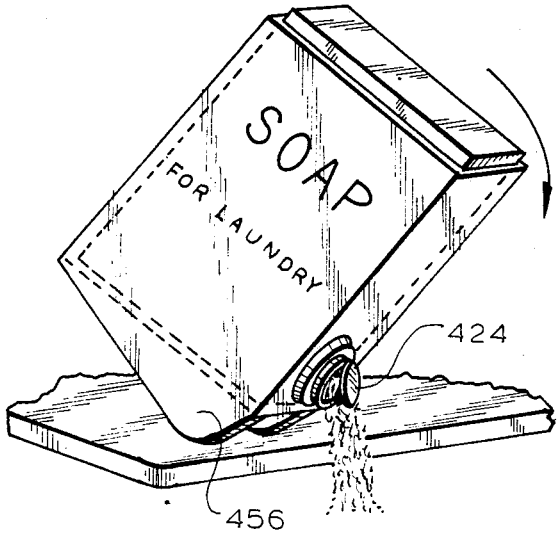
FIG. 12 shows a dispenser unit of the type shown in FIG. 11 being tilted for dispensing.

FIGS. 11 and 12 show an alternative embodiment according to the present invention wherein the dispenser unit has a tiltable base 456 which permits the closure member 424 to be removed without spillage of material, even prior to tilting the dispenser unit about the base 456 for dispensing. The closure member 424 is formed integrally with the tubular member 532 which, itself, can be integrally formed with side wall 536. This embodiment, which permits dispensing without need for removing the package from the shelf, further reduces the chance for accidental spillage and is especially desirable for large-sized boxes such as laundry soap.

Figure 13:
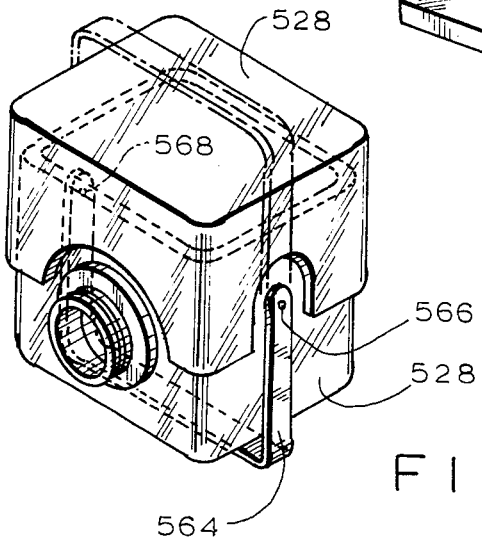
FIG. 13 shows a dispenser unit similar to that shown in FIGS. 9 and 10, but having a cover which telescopes about the outer surface of the side wall and also having a pivotable support which permits tilting the unit and also functions as a handle.

The embodiment of FIG. 13 shows a dispenser unit similar to that shown in FIGS. 9 and 10, but having a cover 558 which telescopes about the outer surface of the side wall 528 and also having a pivotable support 564 which permits tilting the unit and also functions as a handle. FIG. 13 shows the support 564 holding the dispenser unit in position for tilting to dispense the particulate material maintained within a compressible package. The unit tilts about pivot points 566 and 568. The support 564 can swing about these pivot points over the top 558 for ease of carrying.

Figure 14:
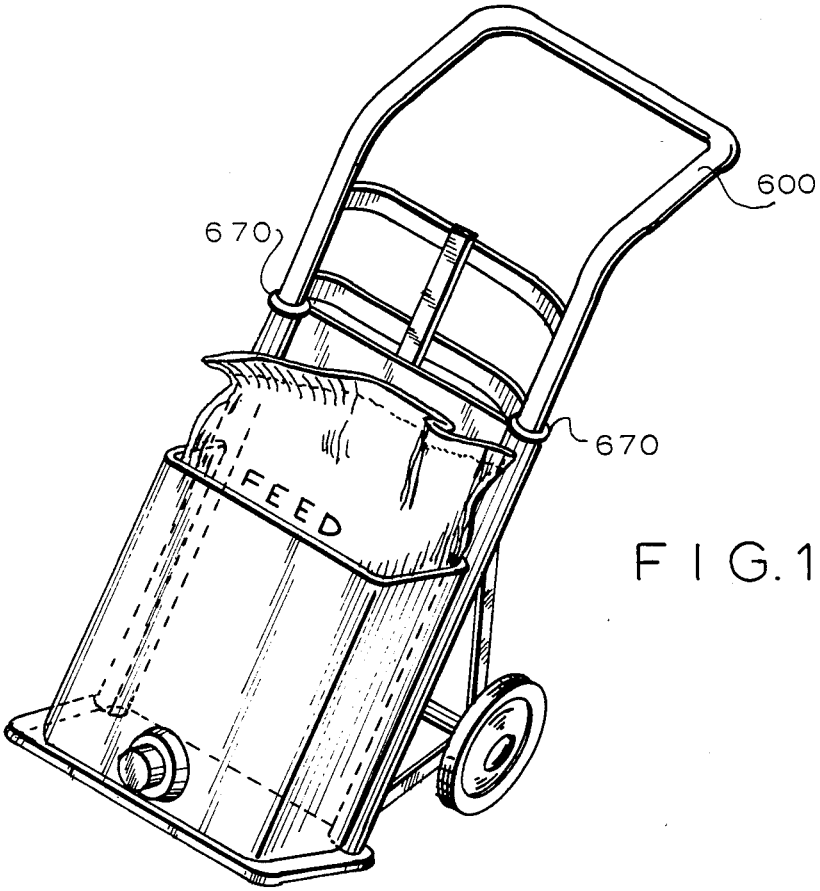
FIG. 14 shows a dispenser unit according to the present invention having means for attaching it to a conventional hand cart having wheels for transporting heavy bags of particulate material.

The embodiment of FIG. 14 shows a dispenser unit according to the present invention having means for attaching it to a conventional hand cart 600 having wheels for transporting heavy bags of particulate material. According to this particular embodiment, the dispenser unit is shown attached to the hand cart 600 by bands 670 and 672 attached to the cart and rests upon the conventional bottom support (not shown) of such a hand cart. Devices of this type are particularly advantageous for holding heavy bags of materials such as animal feed, cement, fertilizer and the like which often need to be transported from place to place where only small portions of material are required.

Figure 15:
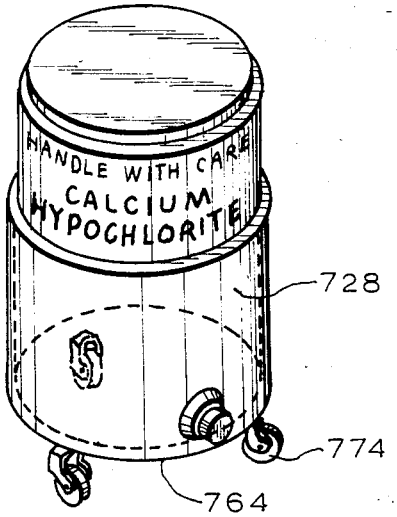
FIG. 15 shows a dispenser unit according to the present invention including a cylindrical upstanding side wall portion with wheels on the bottom of the package support to facilitate the easy transport of large canisters of flowable particulate material.

FIG. 15 shows a dispenser unit according to the present invention which includes a cylindrical upstanding side wall portion 728 with wheels 774 on the base member 764 to facilitate ease of transport of large canisters of flowable particulate matter. This type of arrangement is particularly desirable for chemical materials which are normally stored in large drums and which pose safety problems. Typical of these chemicals are those used for treating swimming pools. Where these containers are something made of metal for added strength due to the need to provide extra safety, the present invention, by the provision of the heavy supporting upstanding side wall 728 can easily facilitate the use of fiberboard containers having plastic liners. Containers of this type can be easily penetrated by the cutting member of the present invention and would enable more economical packaging which could be combined with the increased convenience and overall ease of use of the chemicals when dispensed in accordance with the present invention.

The above description is for the purpose of teaching the person of ordinary skill in the art how to make and use the invention. The description is not intended to describe in detail all of the obvious modifications and variations of the invention. It is intended, however, to include all such obvious modifications and variations within the scope of the present invention which is defined by the following claims.

I claim:

1. A dispenser unit adapted to hold a package containing a flowable, particulate material, to cut an opening in the package, to dispense the desired amount of particulate material, and to cover the opening in the package when dispensing is not desired, comprising:

(a) a support for a package containing flowable particulate material, the support comprising a bottom and an upstanding peripheral side wall portion, the side wall portion having an opening therethrough;

(b) a tubular fitting extending outwardly from said side wall and about said opening;

(c) a tubular cutting member dimensioned to be closely received within said tubular fitting and said opening and adapted to move transversely to said side wall to penetrate said package, said cutting member at one end having a retention flange and at the other end having a piercing member, whereby upon insertion said cutting member cuts an opening in said package enabling unrestricted flow of particulate material from said package and said retention flange abuts the end of said tubular fitting; and (d) a spout member attached to said tubular fitting in abutment with said retention flange on said tubular cutting member; and (e) closure means adapted to cover said spout member.

2. A dispenser unit according to claim 1 wherein said closure means is threaded to engage with threads on said spout.

3. A dispenser unit according to claim 1 wherein said closure means slidably engages said spout.

4. A dispenser unit according to claim 1 which further includes a cover.

5. A dispenser unit according to claim 4 wherein said cover slides in telescoping relationship with said side wall portion.

6. A dispenser unit according to claim 5 wherein said cover slides along the outside of said side wall.

7. A dispenser unit according to claim 1 wherein said bottom has a dihedral configuration.

8. A dispenser unit according to claim 7 wherein said opening is juxtaposed with the lowermost portion of said bottom.

9. A dispenser unit according to claim 1 which further includes a tiltable base.

10. A dispenser unit according to claim 9 wherein said base comprises an extension of said side wall.

11. A dispenser unit according to claim 9 wherein the tiltable base comprises a U-shaped member which is pivotably secured to said side wall at two opposed positions at or above the center of gravity of the unit.

12. A dispenser unit according to claim 1 wherein said tubular cutting member further comprises cut out areas along its tubular body.

* * * * *